United States Patent [19]

Sasaki et al.

[11] Patent Number: 4,566,398

[45] Date of Patent: Jan. 28, 1986

[54] ANCHORING APPARATUS

[75] Inventors: Masahiko Sasaki; Kenji Watanabe; Seiichi Kitamura, all of Tamano, Japan

[73] Assignee: Mitsui Engineering & Shipbuilding Co., Ltd., Tokyo, Japan

[21] Appl. No.: 637,197

[22] Filed: Aug. 3, 1984

[30] Foreign Application Priority Data

Feb. 9, 1984 [JP] Japan ..... 59-22283

[51] Int. Cl.[4] ..... B63B 21/24

[52] U.S. Cl. ..... 114/293

[58] Field of Search ..... 114/199, 200, 293, 144 B, 114/144 R; 254/284, 285, 287, 26, 277, 278–280, 283

[56] References Cited

U.S. PATENT DOCUMENTS 3,774,562 11/1973 Dean ..... 114/293
3,917,229 11/1975 Ayme ..... 254/279

FOREIGN PATENT DOCUMENTS 2813937 10/1978 Fed. Rep. of Germany ..... 114/293
1519591 2/1968 France ..... 254/287

*Primary Examiner*—Trygve M. Blix
*Assistant Examiner*—Jesûs D. Sotelo
*Attorney, Agent, or Firm*—Armstrong, Nikaido, Marmelstein & Kubovcik

[57] ABSTRACT

An anchoring apparatus for a floating offshore structure comprising a mooring plug adapted to rotate relatively to the floating offshore structure. From the mooring plug, an even number of anchor cables are radially stretched to the seabed. On the mooring plug, two mobile windlasses are mounted, which can move under any pair of the even number of diametrically opposed anchor cables, and which haul the pair of anchor cables while holding them with a warping drum and a pressing drum.

6 Claims, 7 Drawing Figures

ANCHORING APPARATUS

BACKGROUND

This invention relates to a rotatable anchoring apparatus which supports a floating offshore structure rotatably in position in mooring the structure.

When a floating offshore structure such as a working boat or an oil rig is anchored at a predetermined location with an anchor cable, a rotatable anchoring apparatus is used to rotatably moor the floating offshore structure so as to leave it less at the mercy of wind and waves.

However, a conventional anchoring apparatus requires as many mobile windlasses as anchor cables, which is the cause of increased manufacturing costs. Furthermore, in a conventional windlass unit, an anchor cable is supported from below by a drum whose axis lies in a horizontal direction, so that a trouble is involved in loading and unloading the anchor cable for maintenance and inspection.

SUMMARY

Accordingly it is an object of this invention to greatly decrease the number of windlass units in order to reduce manufacturing costs.

It is another object of this invention to provide an anchoring apparatus which facilitates maintenance and inspection of a windlass unit drum.

To this end, the anchoring apparatus of this invention has a mooring plug which can rotate relative to a floating offshore structure, from which an even number of anchor cables are radially stretched down to the seabed and which is equipped with two mobile windlasses which can be brought directly under any two of the anchor cables which are diametrically opposite to each other and hoist the anchor cables while holding them with a warping drum and a pressing drum.

According to this invention, the number of windlass units can be greatly decreased, namely to two, and the manufacturing costs can therefore be reduced by the amount corresponding to the number of windlass units which are done without. In addition, the two mobile windlasses can haul an opposing pair of anchor cables simultaneously without disturbing the balance of the floating structure.

Furthermore, maintenance and inspection of the mobile windlass drum, which is normally free of the anchor cable, is made operable at any time.

The above and other objects, features and advantages of the invention will become apparent from the following description taken in conjunction with the accompanying drawings.

THE DRAWINGS

THE PREFERRED EMBODIMENTS

Figure 1:
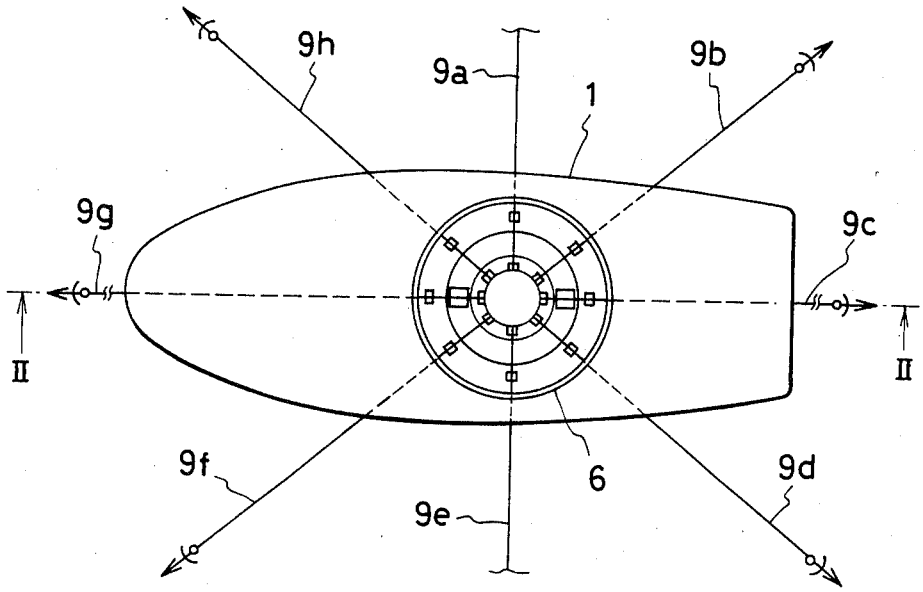
FIG. 1 is a plan view of an anchoring apparatus according to the invention in a process of anchoring a floating structure.

Referring to FIG. 1, in the central part of a floating structure 1, there is a mooring plug 6, which rotates relatively to the floating structure 1.

Figure 2:
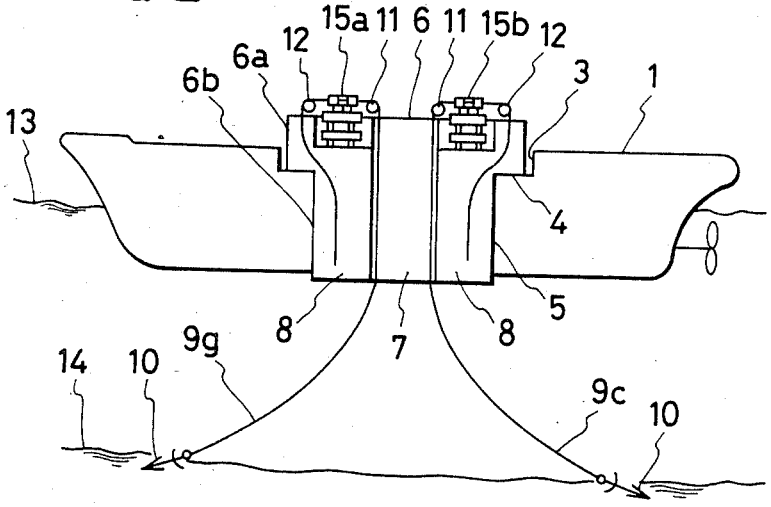
FIG. 2 is a sectional view taken on line II—II of FIG. 1.

This mooring plug 6 is, as shown in FIG. 2, composed of a table 6*a* with a large diameter and a shaft portion 6*b* with a smaller diameter than the table 6*a*, and the table 6*a* is supported on the bottom surface 4 of a recess 3 in the floating structure 1. The shaft portion 6*b* of the mooring plug 6 is inserted into a through bore 5 through the recess 3.

The inner part of the shaft portion 6*b* of the mooring plug forms a chain locker 8. There is a through-bore 7 in the center of the mooring plug 6.

Eight anchor cables 9*a* to 9*h* which are drawn from the chain locker 8 through the through-bore 7 are radially stretched and anchors 10 at ends of the cables reach the seabed 14.

The number of anchor cables is not necessarily limited to eight but should preferably be an even number. This is because simultaneous hauling of a pair of anchor cables prevents any great movement or loss of balance in the floating structure 1. The numeral 13 denotes the water surface.

Figure 3:
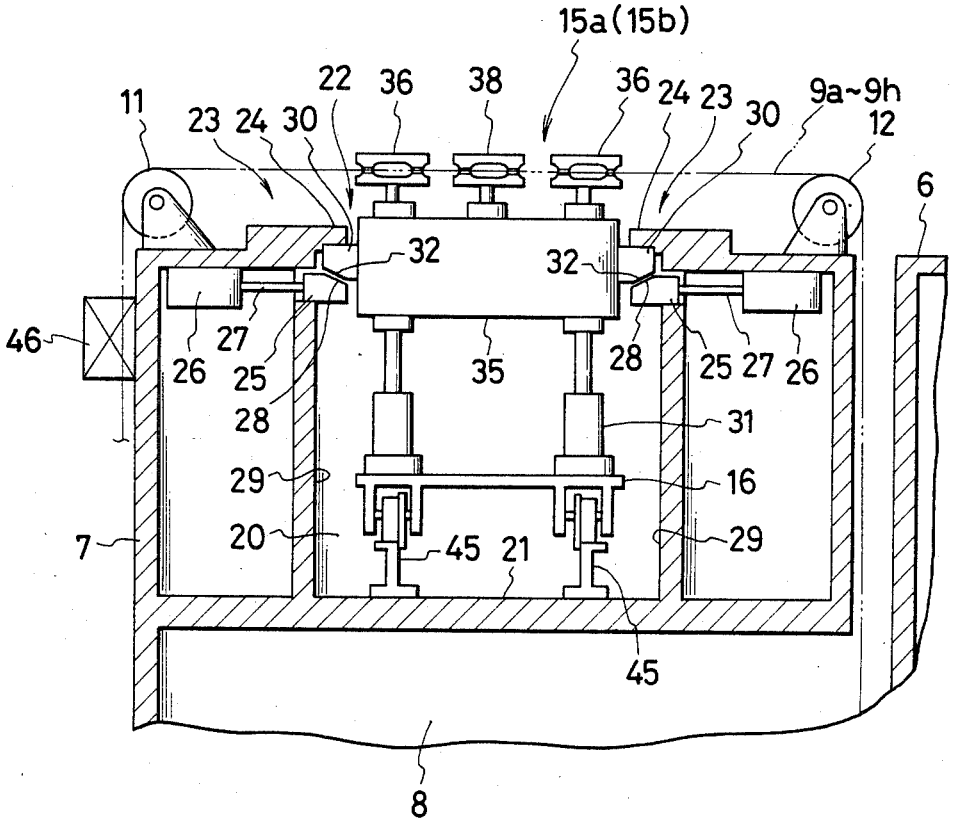
FIG. 3 is an enlarged view of essential parts of the anchoring apparatus according to the invention.

As can be seen in FIG. 3, there is a circular and concave groove-like passage 20 in a mooring plug 6. On the bottom surface of the passage 20 are laid circular rails 45 and 45, on which two mobile windlasses are mounted. On the edge of a circular opening 22 of the passage 20, namely on the upper surface of the mooring plug 6, is mounted a supporting portion 24 comprising a part of a securing device 23. This supporting portion 24 protrudes a little inwards from the side wall 29 of the passage 20.

The anchor cables 9*a* to 9*h* are supported by two guide rollers 11 and 12 mounted on the mooring plug 6, and the securing device 23 which temporarily fixes each of the mobile windlasses 15*a* and 15*b* is installed directly under each of the anchor cables 9*a* to 9*h*. This securing device 23 is composed of the supporting portion 24 mounted on the passage 20 and a stopper 25, which is to be pushed in and out of the passage 20 by a shaft 27 fitting into a cylinder 26 attached to the lower surface of the mooring plug 6. The stopper 25 has a portion in contact with a projection 30 of a windlass unit 35 later to be described, on the slanting surface 28.

The anchor cables 9*a* to 9*h* are usually retained by the chain stopper 46.

Each of the mobile windlasses 15*a* and 15*b* has a windlass unit 35 as shown in FIG. 3, and the windlass unit 35 can be lifted or lowered by means of a hydraulic jack 31 carried on a truck 16.

The windlass unit 35 has projections 30 on both sides of the mobile windlasses in the moving direction. The portion of this projection 30 in contact with the slanting surface 28 of the stopper 25 is in the form of a slanting surface 32.

Figure 5:
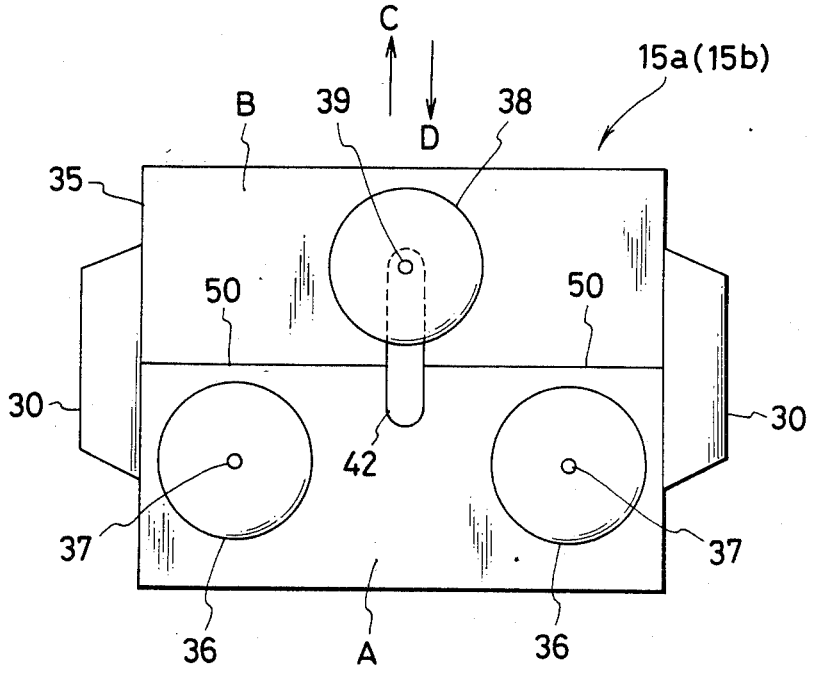
FIG. 5 is a plan view of a mobile windlass.

The windlass unit 35 has two warping drums 36 and 36, and a pressing drum 38. As shown in FIG. 5, on one side A of a reference line 50 on the upper surface of the windlass unit 35, the windlass unit 35 has the two warping drums 36 and 36 arranged parallel to the reference line 50, and on the other side B, the pressing drum 38, which is adapted to move towards the area between the two warping drums 36 and 36. To help the movement of the pressing drum 38, a guide slit 42 is cut in the windlass unit 35.

The reference line 50 lies in the same direction as an anchor cable between the two guide rollers 11 and 12. On the other hand, a shaft 37 of the warping drum 36 and a shaft 39 of the pressing drum 38 are vertical.

The drums of the windlass unit are not limited to the above structure since a windlass unit composed of one warping drum and one pressing drum can haul anchor cables.

The operation of hauling anchor cables with the mobile windlass will be explained next.

It has already been stated that in hauling anchor cables, an opposing pair of anchor cables are simultaneously hauled in order to keep the balance of the floating structure 1.

Figure 4:
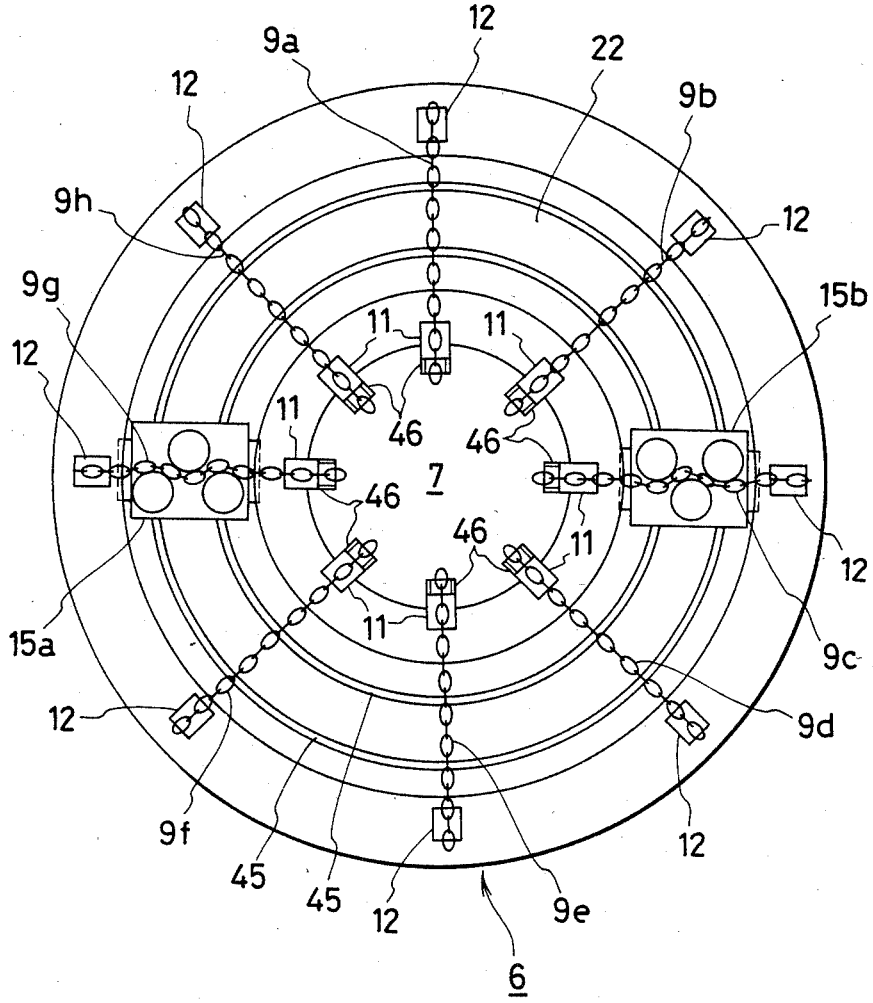
FIG. 4 is a plan view of the anchoring apparatus according to the invention.

In hauling the anchor cables 9*c* and 9*g* at the same time, as shown in FIG. 4 the mobile windlass 15*a* is moved directly under the anchor cable 9*g*, and the mobile windlass 15*b* is moved directly under the anchor cable 9*c*.

Now, the operation of holding the anchor cable 9*g* by the mobile windlass 15*a* will be described, this being identical to the operation of holding the anchor cable 9*c* by the mobile windlass 15*b*.

When the mobile windlass is moved, the windlass unit 35 on the mobile windlass 15*a* is lowered by the jack 31, and the warping drums 36 and 36 and the pressing drum 38 installed on the windlass unit 38 are in a lower position than the anchor cable 9*g*. As shown in FIG. 5, the pressing drum 38 is away from the reference line 50 in the direction of an arrow C.

The windlass unit 35 is next pushed upward by the jack 31 carried on the truck 16 until the projection 30 which is fixed to the windlass unit 35 comes into contact with the supporting portion 24 of the mooring plug 6.

Figure 6:
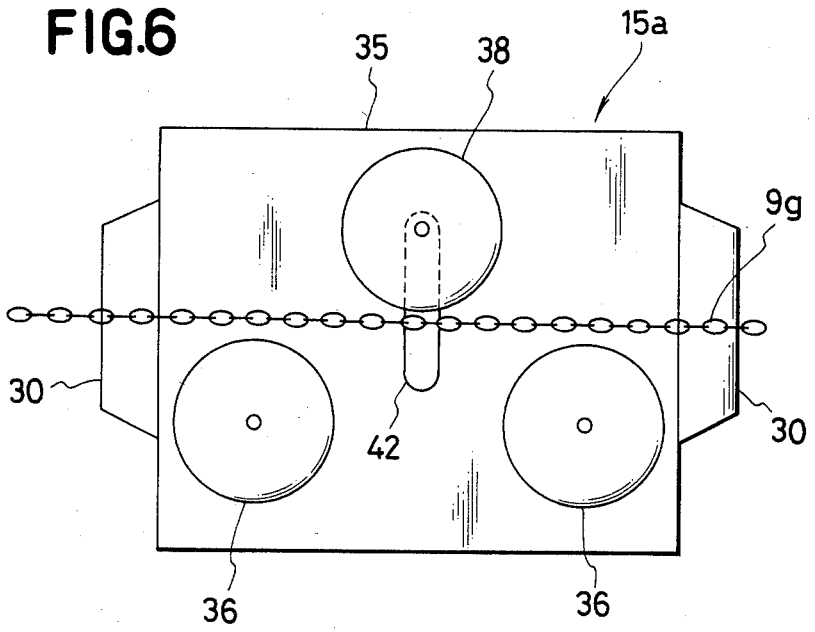
FIG. 6 is a plan view of a windlass unit in which an anchor cable is lodged between driving drums and a pressing drum.

Then the projection 30 of the windlass unit 35 is pressed by the stopper 25 which is pushed out by the cylinder 26 attached to the lower surface of the mooring plug 6, and the stopper 25 and the supporting portion 24 can tightly clamp the windlass unit 35. At this time, the anchor chain 9*g* is lodged between the two driving drums 36 and 36, and the pressing drum 38, as in FIG. 6.

Figure 7:
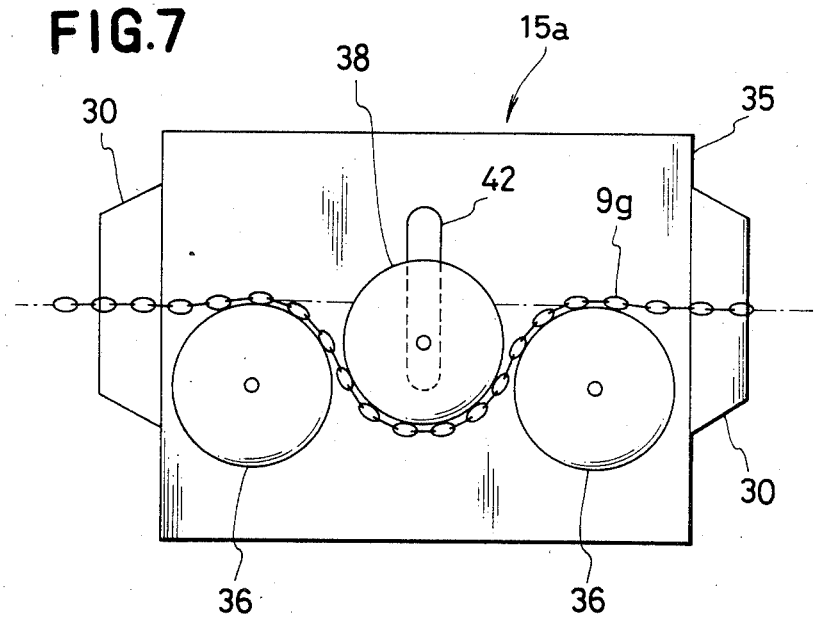
FIG. 7 is a plan view of a windlass unit in a process of holding the anchor cable between the driving drums and the pressing drum.

When the pressing drum 38 is moved in the direction of an arrow D, the anchor chain 9*h* is held by the two warping drums 36 and 36 and the pressing drum 38, as in FIG. 7.

By releasing the stopper 46 of each of the anchor cables 9*c* and 9*g* and operating the warping drums 36 and 36, the two anchor cables 9*c* and 9*g* are hoisted at the same time, and each of the anchor cables 9*c* and 9*g* is secured by the stopper 46 after hoisting has been completed.

The pressing drum 38 is next moved back in the direction of the arrow C, and thereafter the windlass unit 35 is lowered by the jack 31.

Other pairs of anchor cables 9*d* and 9*h*, 9*a* and 9*e*, and 9*b* and 9*f* are hauled by the same operation as for anchor cables 9*c* and 9*g*.

This invention is not limited to the above embodiment but includes changes and variations within the spirit and the scope of the invention.

We claim:

1. An anchoring apparatus for a floating offshore structure comprising: a mooring plug rotatably fitted relative to said floating offshore structure, a plurality of pairs of diametrically opposed anchor cables radially stretched from said mooring plug to the seabed, and a pair of mobile windlasses mounted on said mooring plug and movable to respective positions under any pair of said diametrically opposed cables, each of said windlasses carrying a warping drum and a pressing drum for engaging and clamping onto the corresponding cable when said windlass is so positioned with respect thereto to haul said clamped cable.

2. An anchoring apparatus for a floating offshore structure comprising: a mooring plug rotatably fitted relative to said floating offshore structure, a plurality of pairs of diametrically opposed anchor cables radially stretching from said mooring plug to the seabed, at least two guide rollers mounted on said mooring plug for supporting each of said anchor cables, and a pair of mobile windlasses mounted on said mooring plug and movable to respective positions under any pair of said diametrically opposed cables, securing devices installed directly under each of said anchor cables for temporarily fixing said mobile windlasses, a circular and concave groove-like passage for accommodating said mobile windlasses, and each of said mobile windlasses including a pair of right and left projections to be clamped by said securing devices, each of said windlasses carrying a warping drum and a pressing drum for engaging and clamping onto the corresponding cable when said windlass is so positioned with respect thereto to haul said clamped cable.

3. An anchoring apparatus according to claim 2, wherein said mobile windlass includes a truck and a windlass unit which can be lifted or lowered by means of a jack carried on said truck.

4. An anchoring apparatus according to claim 2, wherein circular rails are laid in said circular passage and each of said mobile windlasses is mounted on said rails.

5. An anchoring apparatus according to claim 3, wherein said windlass unit is composed of two warping drums arranged on one side and a pressing drum arranged on the other side for pressing said anchor cables to said two warping drums.

6. An anchoring apparatus according to claim 2, wherein the upper part of said groove-like passage is open, and said securing device is composed of a supporting portion fitted on an edge portion of the opening and a stopper adapted to slide in and out of said passage.

* * * * *